US005790752A

United States Patent [19]

Anglin et al.

[11] Patent Number: 5,790,752

[45] Date of Patent: Aug. 4, 1998

[54] EFFICIENT IN-LINE FLUID HEATER

[75] Inventors: Noah L. Anglin; Roy J. Machamer, both of San Jose; Stanley J. Hludzinski, Alviso; Robert G. Garber, San Jose, all of Calif.

[73] Assignee: Hytec Flow Systems, San Jose, Calif.

[21] Appl. No.: 575,408

[22] Filed: Dec. 20, 1995

[51] Int. Cl.[6] ..... F24H 1/10

[52] U.S. Cl. ..... 392/483; 392/419; 392/422

[58] Field of Search ..... 392/483, 411, 392/416, 422, 423, 424, 426, 428, 419, 420, 421; 219/486

[56] References Cited

U.S. PATENT DOCUMENTS

| | | | |
|---|---|---|---|
| 3,167,066 | 1/1965 | Hughes | 392/483 |
| 4,533,820 | 8/1985 | Shimizu | 392/483 |
| 4,550,245 | 10/1985 | Arai et al. | 392/422 |
| 4,639,579 | 1/1987 | Brooks et al. | 392/411 |
| 4,914,276 | 4/1990 | Blair | 392/483 |
| 4,968,871 | 11/1990 | Hamrin | 392/422 |
| 5,422,460 | 6/1995 | Bralia et al. | 392/422 |

FOREIGN PATENT DOCUMENTS 1523023 8/1978 United Kingdom .

*Primary Examiner*—Tu B. Hoang
*Attorney, Agent, or Firm*—Haverstock & Associates

[57] ABSTRACT

A highly efficient in-line fluid heater is suitable for heating ultra-pure fluids. Preferably, the heater can be used for heating various fluids, including water, as part of a "wet bench" system used in a wafer processing fabrication facility for the semi-conductor industry. Many other uses for this in-line heater can be envisioned; e.g., water industry, gas processing, and any other use requiring an ultra-clean, highly efficient, non-contact method of raising the temperature of various liquids and gases. The preferred in-line heater utilizes one or more elongated lamps that generate IR radiation as the heating elements. A vessel is provided through which the fluid to be heated is passed. Typically, the vessel is a tube. The tube is preferably a straight single diameter tube, but can be formed in any convenient shape. For ultra-pure fluids, the vessel is formed of an inert or non-reactive material such as quartz. Preferably, the vessel is transparent to the IR radiation generated by the lamps. A chamber surrounds the lamps and the vessel. The interior surface of the chamber is made of a highly efficient reflecting material, preferably gold. The chamber is configured to have an integrally formed elongated parabolic reflector, one for each lamp to reflect radiation from the lamp toward the vessel. Each lamp is located at the focal point of its respective parabolic reflector. For systems having more than one lamp, the lamps are proportionally located around the inside periphery of the chamber. Preferably, the parabolic reflectors are sufficiently deep that radiation from one lamp cannot impinge directly onto any other lamp, thereby avoiding heating the lamps.

15 Claims, 4 Drawing Sheets

EFFICIENT IN-LINE FLUID HEATER

FIELD OF THE INVENTION

This invention relates to the field of in-line heaters for fluids. More particularly, this inventions relates to highly efficient, long life in-line heaters for heating fluids without introducing contaminates to the fluid being heated.

BACKGROUND OF THE INVENTION

Heated ultra-pure fluids are used for a variety of reasons. For example, hot fluids are required during several processing steps in the manufacture of an integrated circuit. It is typically impractical to first heat the liquid and then purify it. Accordingly, it is preferable to first purify the fluid (or obtain a pure fluid) and then heat it to the desired temperature.

The prior art teaches a number of techniques for heating ultra-pure liquids. For example, Layton et al., U.S. Pat. No. 4,461,347, issued Jul. 24, 1984 teaches immersing a heat source within a stream of the fluid to be heated. The heating element is ensheathed within a non-reactive material to prevent contamination of the fluid. The transfer of the heat to the fluid is by conduction. Unfortunately, the hotter the heat source the more likely that contamination will result. Further, Layton teaches that the non-reactive sheath is preferably a plastic such as PTFE or polypropylene, both of which are thermally insulative, thereby reducing the efficiency of the transfer of heat to the fluid. Martin, U.S. Pat. No. 4,797,535, issued Jan. 10, 1989 teaches heating a fluid by immersing a tungsten-halogen bulb in the fluid within a vessel, such as a pipe. As the fluid passes the bulb, heat transfers to the fluid. Martin does not appear to contemplate ultra-pure fluids, and no precautions are taken or taught for maintaining the purity of the fluid.

Batchelder, U.S. Pat. No. 5,054,107, issued Oct. 1, 1991 teaches a system for heating ultra-pure fluids. In particular, a quartz spiral or double walled tube is configured to surround several high intensity lamps. The fluid to be heated flows through the quartz tube. The lamps are not immersed in the fluid but radiate energy (infrared) outward through the tube and the liquid. The construction is wrapped in aluminum foil to reflect radiation which passes beyond the tube back through the fluid.

It is well recognized that the operative life of lamps of this type is greatly diminished as a result of high temperature operating conditions. Batchelder appears to recognize this and discloses a fixture for removing heat from the ends of the bulbs. Nevertheless, Batchelder teaches that up to twelve lamps can be mounted within the center of the quartz tube. These lamps will necessarily heat one another, thereby reducing the effective lifetime for the system, requiring more frequent routine maintenance for lamp replacement.

The Batchelder system also teaches that aluminum foil can be used to reflect radiation back towards the fluid. It is well known that aluminum is absorptive of infrared radiation. As such the overall efficiency of the system is degraded.

SUMMARY OF THE INVENTION

This present invention is for a highly efficient in-line fluid heater that is suitable for heating ultra-pure fluids. Preferably, the heater of the present invention can be used for heating various fluids, including water, as part of a "wet bench" system used in a wafer processing fabrication facility for the semi-conductor industry. Many other uses for this highly efficient in-line heater can be envisioned; e.g., water industry, gas processing, and any other use requiring an ultra-clean, highly efficient, non-contact method of raising the temperature of various liquids and gases.

The preferred in-line heater utilizes one or more elongated lamps that generate IR radiation as the heating elements. A vessel is provided through which the fluid to be heated is passed. Typically, the vessel is a tube. The tube is preferably a straight single diameter tube, but can be formed in any convenient shape. For ultra-pure fluids, the vessel is formed of an inert or non-reactive material such as quartz. Preferably, the vessel is transparent to the IR radiation generated by the lamps.

A chamber surrounds the lamps and the vessel. The interior surface of the chamber is made of a highly efficient reflecting material, preferably gold, to avoid having the reflector absorb radiation energy. The chamber is configured to have an integrally formed elongated parabolic reflector, one for each lamp to reflect radiation from the lamp toward the vessel. Each lamp is located at the focal point of its respective parabolic reflector. For systems having more than one lamp, the lamps are proportionally located around the inside periphery of the chamber. Preferably, the parabolic reflectors are sufficiently deep that radiation from one lamp cannot impinge directly onto any other lamp, thereby avoiding heating the lamps.

DETAILED DESCRIPTION OF THE PREFERRED EMBODIMENT

Figure 1:
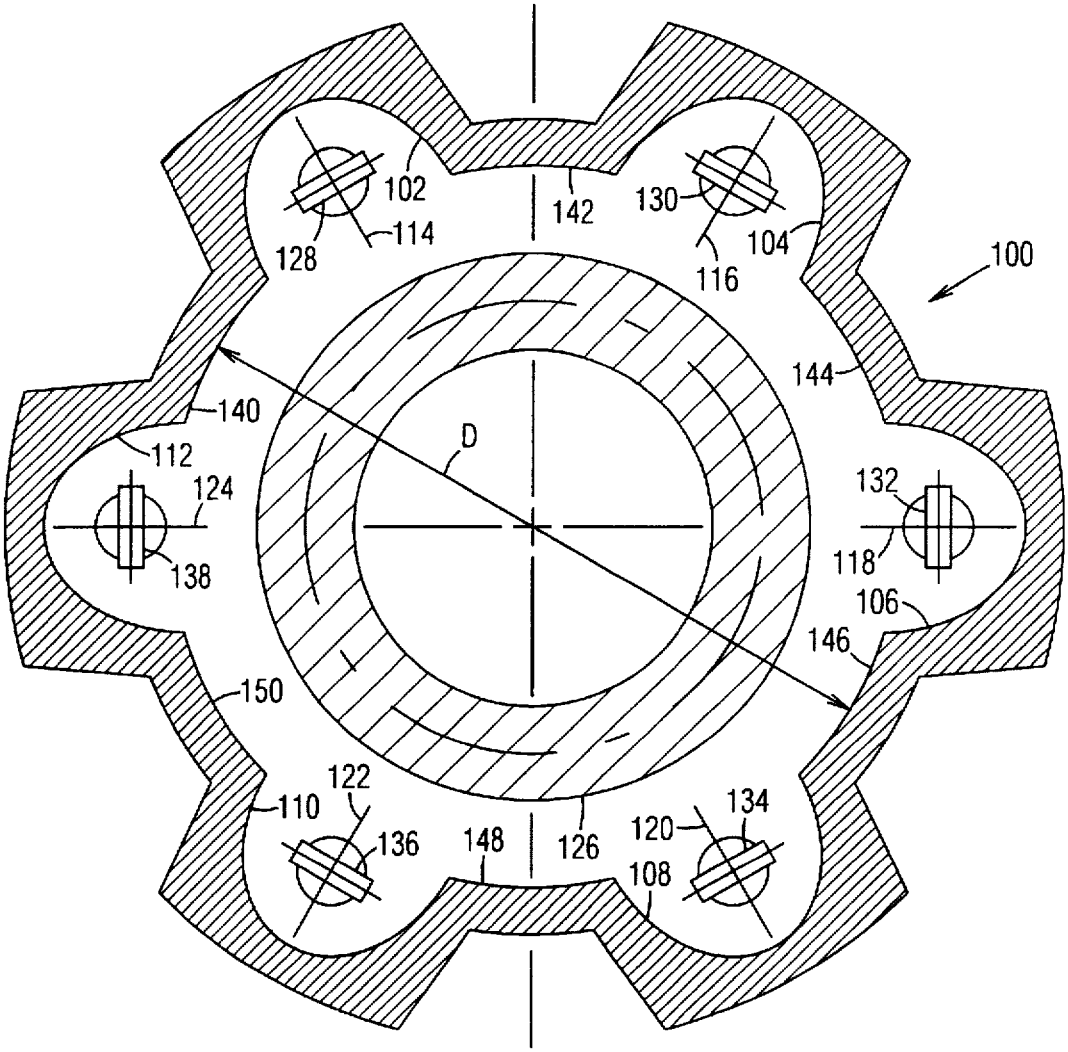
FIG. 1 shows a cross section of the chamber for the in-line heater of the present invention.

FIG. 1 shows a cross section of the preferred chamber 100 for the in-line heater of the present invention. The interior surface of the chamber 100 is generally a closed complex cylinder. (It is well recognized in mathematics that a cylinder is a geometric shape formed by moving a line through a path such that the line is always parallel. A can (like a soup can) is generally called a cylinder but is more accurately called a truncated right circular cylinder.) A plurality of parabolic reflectors 102, 104, 106, 108, 110 and 112 are integrally formed into the interior surface of the chamber 100. The cross section (shown) of each parabolic reflector 102 through 112 is designed to follow the curve for a mathematical parabola and has a parabolic axis 114, 116, 118, 120, 122 and 124, respectively. The preferred embodiment includes six parabolic reflectors.

It will be apparent to one of ordinary skill in the art that any convenient number of parabolic reflectors can be used. As will be understood from the discussions that follow, more parabolic reflectors allow more heating lamps to be used which in turn will allow more heating energy to be applied to the fluid.

The use of parabolic reflectors around the periphery of the chamber 100 allows the IR energy of the lamps to be "focused" by the parabolic lens and hence directed at the fluid passing through the chamber 100. This is very important in that by focusing the IR energy toward the media to be heated up the efficiency of the system is improved. This is unlike the prior art devices using radiant lamps wherein the lamps simply radiated the energy in a non focused manner in all directions.

A vessel 126 used to carry fluid to be heated is positioned within the chamber. Preferably, the vessel is a straight segment right circular cylinder. The vessel is formed of an inert or non-reactive material to avoid contaminating the fluid. According to the preferred embodiment, the vessel is formed of quartz. The size of the quartz cylinder needs to be determined as a function of the flow rate of liquid to be moved through the heater. Sizes for ½ inch diameter up to about 3 inches in diameter can be used. When considering the size to make the quartz tube, it is important to note that it is desired that the volume of liquid presented to the heaters should be as large a proportion of the total mass as possible in that the mass of the quartz present also absorbs some percentage of the IR energy and keeps that amount of energy from being absorbed by the liquid you are trying to heat. Of course, the quartz gradually heats up and uses less of the available energy.

It will be appreciated that other configurations of a vessel can be used with varying degrees of success. For example, the vessel can be a quartz spiral. In the event the vessel is a spiral, it is preferred that the adjacent turns of the spiral be in contact with one another to prevent radiation from one lamp, eg., 128, from passing through the spiral and impinging onto the opposite lamp, eg., 134.

End plates (not shown) are adapted to accept and hold one high intensity lamp 128, 130, 132, 134, 136 and 138 for each parabolic reflector 102 through 112, respectively. The lamps 126 through 136 are shown schematically. The lamps 126 through 136 are held at or near each end by the end plates. The end plates are designed to position each lamp at the focal point of its parabolic reflector. In this way, radiation that impinges from one of the lamps onto its parabolic reflector will be reflected parallel to the axis of the parabolic reflector.

The lamps are selected for producing peak IR radiation within a predetermined range of wavelengths. The peak is selected to enhance efficiency of heat transfer to the fluid to be heated. The power delivered to the lamps can be adjusted to select optimal wavelengths. Under certain circumstances, lamps having different operating characteristics can be selected to accommodate heating fluids having widely variant heat absorption properties.

Circular arc lands 140, 142, 144, 146, 148 and 150 are formed between the parabolic reflectors. The arc lands 140 through 150 join the parabolic reflectors 102 through 112 into a complex cylinder. Preferably, the arc lands form a broken circle of diameter D. The vessel 126 can be selected to have any diameter up to D. It is important that the vessel be sufficiently large in diameter to prevent the radiation from one lamp from impinging directly onto another lamp. In this way the majority of the radiation is absorbed by the fluid and does not heat the lamps. This provides a longer effective lifetime for the system.

The amount of heating of the fluid is a function of the amount of incident radiant energy multiplied by the volumetric flow rate of the fluid through the vessel 126. According to the preferred embodiment the lamps are each configured to consume 2 KW of electrical energy. Therefore, assuming the lamps are highly efficient at converting electrical energy to IR radiant energy, each lamp radiates approximately 2 KW of IR radiation. By selectively activating one through six lamps, between 2 through 12 KW of radiant energy can be delivered to the fluid.

As described above, the preferred embodiment includes six parabolic reflectors 102 through 112 and six lamps 128 through 138. If a smaller number of lamps are needed, the lamp can be left out during assembly of the device or removed to provide a smaller heating capacity. Any stray radiation that enters such a parabolic reflector will reflect back into the chamber 100 and into the fluid within the vessel 126. In the alternative, a reflective plug, eg., a ceramic plug coated with a reflective surface can be inserted into the empty parabolic reflector.

Figure 2:
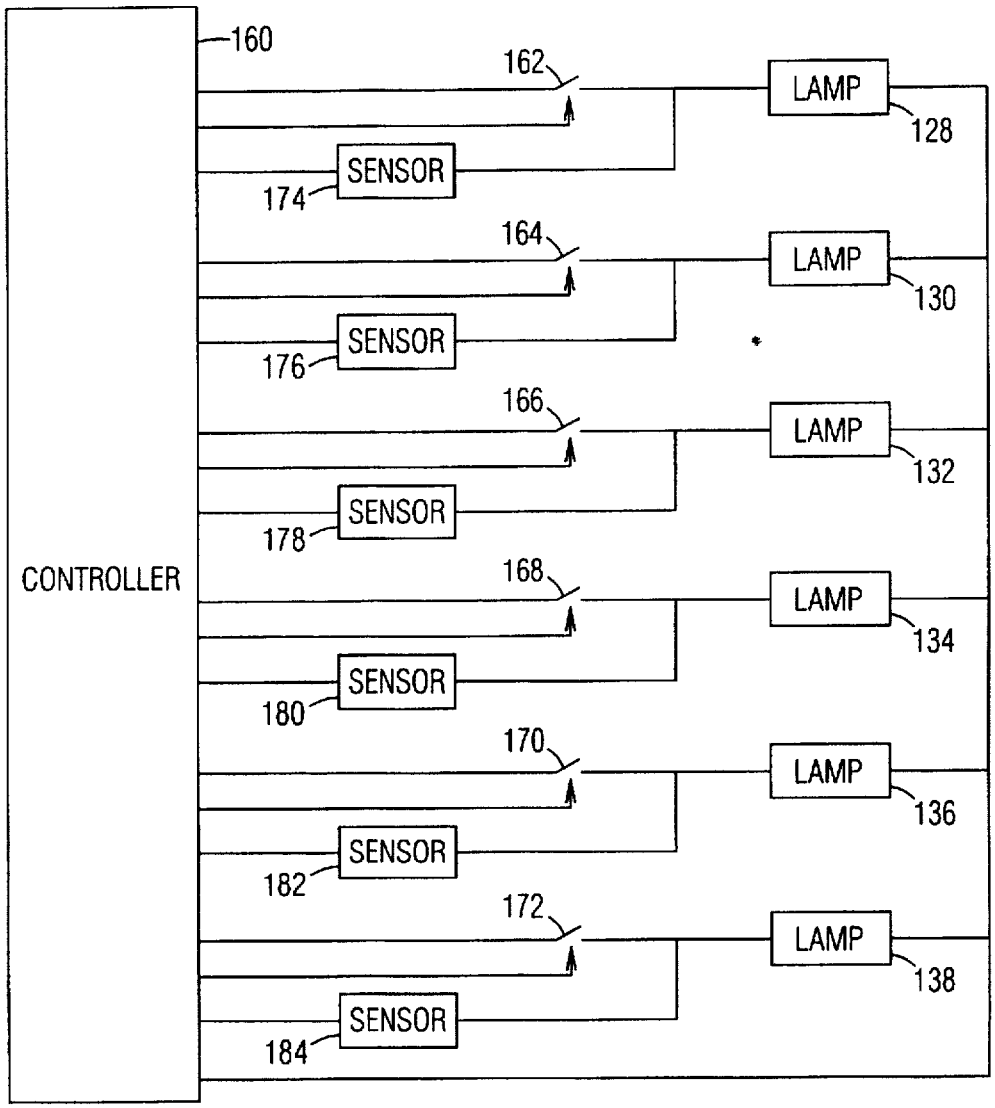
FIG. 2 shows a block diagram of the control circuit for the present invention.

FIG. 2 shows a block diagram of a control circuit for a preferred embodiment of the present invention. A controller 160 is coupled to activate one or more of the lamps depending upon the desired heating capacity. For example, if 12 KW of radiant energy is required, then the controller 160 activates all six of the lamps 128 through 138. The controller 160 is coupled to control six switches 162, 164, 166, 168, 170 and 172 which each apply power to one of the six lamps 128 through 138, respectively. Sensors 174, 176, 178, 180, 182 and 184 are coupled to sense the operation of the lamps 128 through 138, respectively. The sensor can be coupled to sense either the current drawn by the lamp or the voltage across the lamp. Because the operating characteristics of the lamp are known, the sensor can be used to determine when the lamp has failed or its performance has degraded to a predetermined failed condition. In either case the controller will open the switch 162 through 172 that is coupled to the failed lamp 128 through 138. Under certain circumstances, this will prevent the circuit from damaging itself by attempting to drive a bad lamp.

The heater of the present invention is intended primarily for a manufacturing environment to heat a fluid used in the manufacture of integrated circuits. For such equipment, continuous operating time between either failure or routine maintenance (also called 'up time') is an important design consideration. For applications requiring heating with only 6 KW of radiant energy, the controller 160 can be configured to arbitrarily select any three of the lamps 128 through 138 by closing the three respective switches 162 through 172. As any one of the lamps 128 through 138 fails, the controller 160 automatically opens the switches 162 through 172 for the failed lamp 128 through 138 and closes the switch for one of the lamps that is previously unused. This technique provides lamp redundancy for a heater requiring less than 12 KW of radiant energy and will thereby increase up time for such a system. For a 6 KW system this technique will effectively double the up time, for a 4 KW system the up time is tripled.

Figure 3:
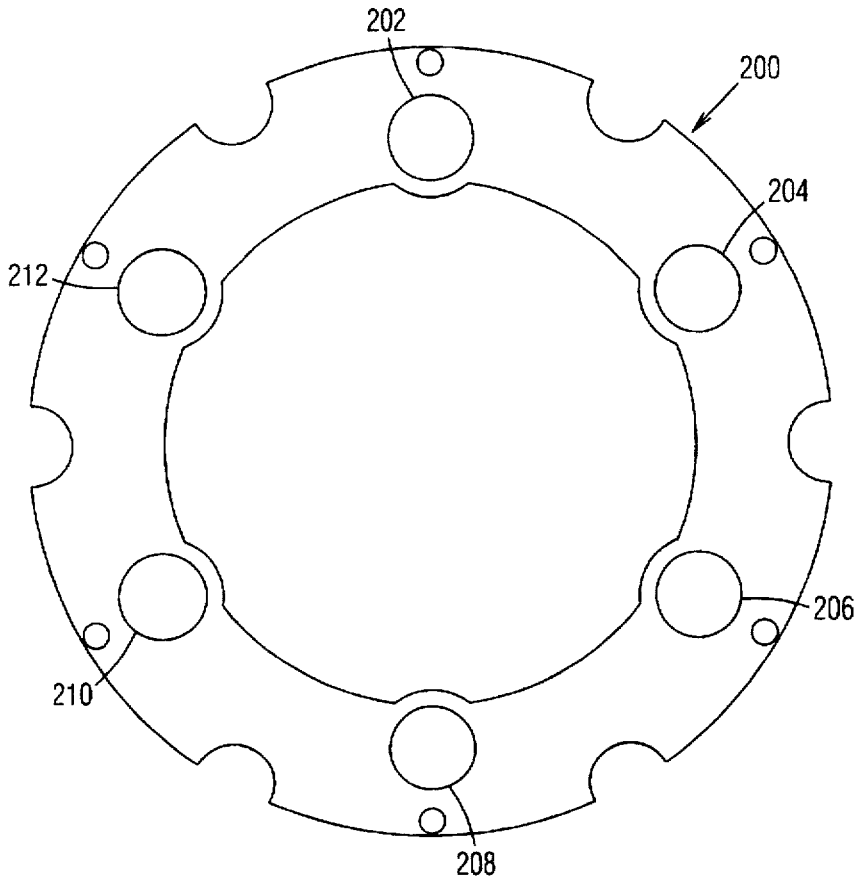
FIG. 3 shows a plan view of one of the two end caps 200 of the heater of the present invention.
Figure 4:
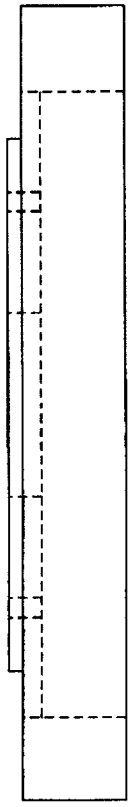
FIG. 4 shows a cross section view of the end cap of FIG. 3.

FIG. 3 shows a plan view of one of the two end caps 200 of the heater of the present invention. The end cap 200 is mounted to one of the ends of the chamber 100 (FIG. 1). A second end cap will be used at the opposite end of the chamber 100. Both end caps are designed to be identical to one another. The end cap 200 has a generally circular construction. Six lamp apertures 202, 204, 206, 208, 210 and 212 are provided to allow a lamp to be mounted therethrough. FIG. 4 shows a cross section view of the end cap of FIG. 3.

The fluid is preferably applied to and removed from the vessel via a feed tube (not shown) at each end of the vessel. The feed tubes are also preferably formed of an inert or nonreactive material to prevent contamination of the fluid. As is well known, the feed tubes can be integrally formed with the vessel. It will be apparent to one of ordinary skill in the art that the feed tubes must each pass through an aperture in the wall of the chamber or through the end cap. Any convenient location for the apertures can be used.

Once the end caps are mounted in place, the vessel allows fluid to pass through the enclosed structure of the heater of the present invention. It is desirable that all the radiant energy produced by the lamps impinge onto the fluid to impart the greatest heating efficiency. To this end the interior surfaces of the chamber 100 (FIG. 1) and the end caps 200 (FIG. 3) are coated with a reflective material. The reflective material should be highly reflective of the wavelength IR radiation produced by the lamps 128 through 138 (FIG. 1).

The inventors have determined that gold is highly efficient at reflecting IR radiation. Indeed, experimental results indicate that a gold reflecting surface will reflect a higher percentage of incident IR radiation than polished aluminum, stainless steel or nickel plating. It is important that most of the IR energy is reflected rather than absorbed. The energy that is absorbed goes to heat up the reflectors and thus moves through the system by radiation, conduction, and convection; gradually to the environment, in other words, this is wasted energy as you want the energy developed to go into heating up the liquid in the quartz tube, not into lost energy given up as heat loss.

According to the preferred embodiment, a gold layer is electroplated onto the interior surfaces of the chamber and end plates. The gold reflective layer can be formed by other well known techniques such as deposition and to any convenient thickness.

Figure 5:
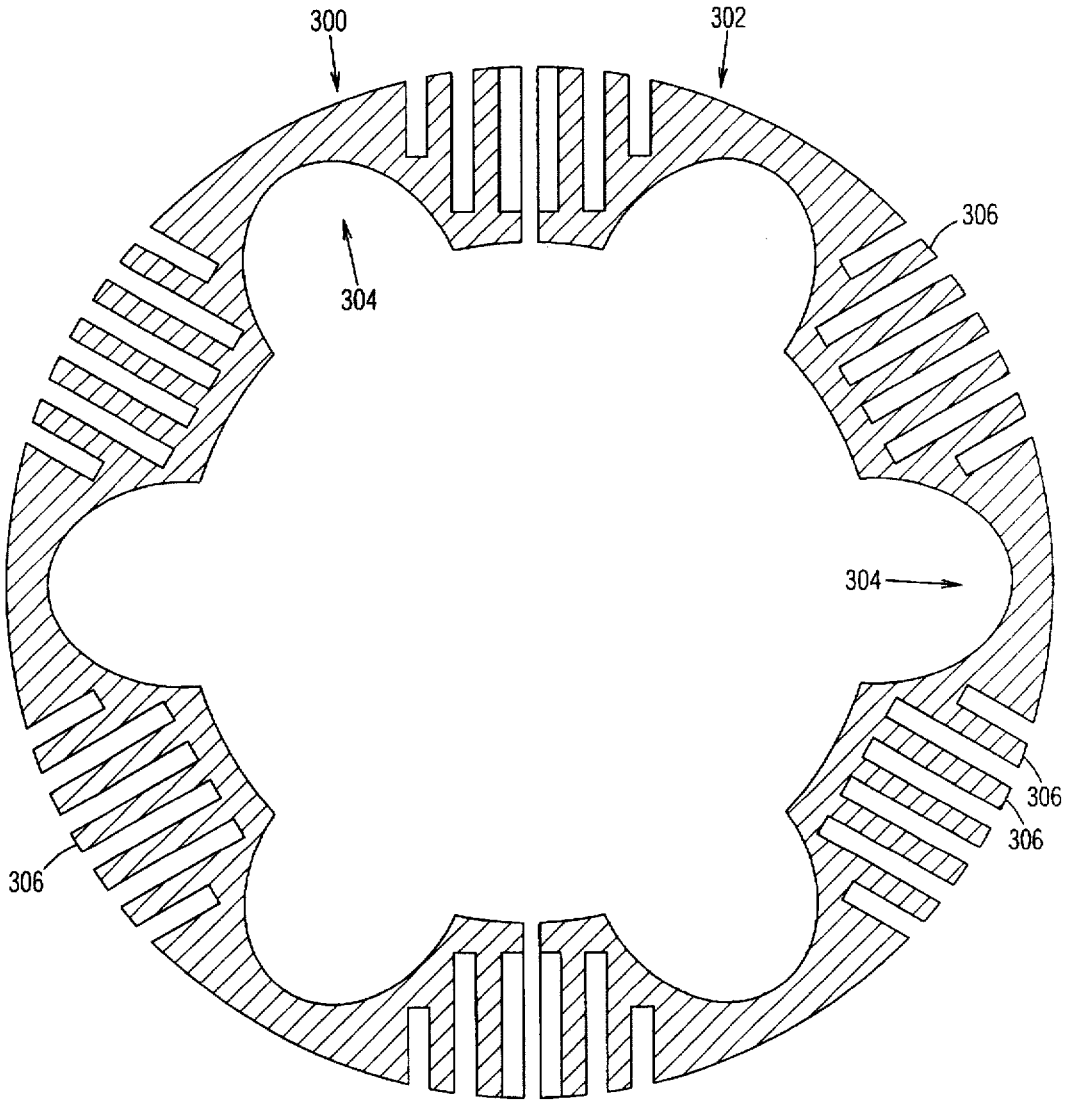
FIG. 5 shows a cross section view of the chamber of the preferred embodiment.

The chamber can be made using a variety of well known manufacturing techniques. However, the preferred chamber is made up of two halves 300 and 302 of aluminum formed preferably by extrusion as shown in FIG. 5. Each of the two halves includes 3 parabolic reflectors 304 as described above. The two halves are joined to form the chamber 100. The appropriate interior surfaces of the extruded halves and the end caps are plated with gold. Even though gold is used for the reflecting material a modest amount of IR radiation will be absorbed by the chamber. For this reason, cooling fins 306 are included in the extrusion die to aid in dissipating the absorbed heat into the ambient environment. Cooling air can be blown over or through the chamber to aid in heat removal.

One side of the box is the entry side which contains the coolant air input; clean dry air at line pressure, 60 to 100 psi, with at least a ⅜ inch entry. The other end of the box or cover set is the exit side which will also contain the exit port the hot air (cool air enters the chamber at the entry side and flows down the outside of the reflecting chamber and the heated air exits at the exit end plate); this exit exhaust should be approximately 1½ to 2.0 inches in diameter to scavenge the heated air efficiently without a back pressure buildup.

Provisions are also made at the entry end and at the exit end to direct the inlet air towards the lamp ends which should be cooled for long life. Another major difference between the present invention and existing technologies is that the "open area" between the outside of the chamber and the inside of the box which contains the unit has no "insulation" materials filling the "air cavity." The efficiency of the air cooling coupled with the minimal amount of heat allowed to escape the chamber by absorption of the IR energy is such that only the air cooling is required to keep the outside of the box which contains the apparatus from getting so hot that it is "uncomfortable" to human touch.

It should also be noted that the length of the chamber was chosen for this system to accommodate a particular commercially available IR lamp rated at 2 KW power. Other lamps with other power ratings may be longer or shorter than the chosen lamp. It will be apparent to one of ordinary skill in the art after reading this disclosure that the chamber can readily be made longer or shorter by appropriately cutting the extrusion to accommodate various lengths of lamps. The cross section view would remain the same, only the length would change. Also, the cross section was chosen as a convenient one in size. As with the length, the cross section could be made larger or smaller.

The present invention was described relative a specific preferred embodiments which are not intended to limit the interpretation of this patent document. Changes and modifications that become apparent to those of ordinary skill in the art only after reading this disclosure are deemed within the spirit and scope of the appended claims.

What is claimed is:

1. An in-line heater for heating fluid comprising:

a vessel for carrying a fluid to be heated wherein the vessel is substantially transparent to radiant energy;

a chamber surrounding the vessel having a reflective interior surface wherein the reflective interior surface is formed of gold;

one or more radiant energy sources mounted within the chamber; and a sensor electrically coupled to the radiant energy source for detecting whether the radiant energy source has failed.

2. The in-line heater according to claim 1 wherein the chamber further comprises a plurality of parabolic reflectors each having one of the radiant energy sources mounted at a focal point of a corresponding one of the parabolic reflectors for focussing radiant energy onto the fluid.

3. The in-line heater according to claim 2 wherein the vessel and both the parabolic reflectors and the radiant energy sources are substantially linear.

4. The in-line heater according to claim 3 further comprising means for selectively activating only a predetermined number of the radiant energy sources for forming a predetermined amount of radiant energy.

5. The in-line heater according to claim 4 further comprising means for automatically substituting an operating radiant energy source for a failing radiant energy source.

6. The in-line heater according to claim 3 further comprising means for selectively forming the chamber of any predetermined length.

7. An in-line heater for heating fluid comprising:

a vessel for carrying a fluid to be heated wherein the vessel is substantially transparent to radiant energy;

a chamber surrounding the vessel having a reflective interior surface including a plurality of parabolic reflectors;

a plurality of radiant energy sources each mounted within the chamber at a focal point of each of the parabolic reflectors for focusing radiant energy onto the fluid and for preventing radiant energy from a first radiant energy source from directly impinging onto a second radiant energy source; and a controller electrically coupled to the plurality of radiant energy sources for detecting and deactivating a failed one of the plurality of radiant energy sources.

8. The in-line heater according to claim 7 wherein the vessel is chemically inert to the fluid.

9. The in-line heater according to claim 8 wherein the chamber is formed by extrusion.

10. The in-line heater according to claim 9 wherein the chamber further comprises fins for dissipating absorbed heat.

11. The in-line heater according to claim 10 further comprising means for delivering a stream of air into the chamber but external to the vessel to remove heat absorbed by the chamber.

12. The in-line heater according to claim 8 wherein the chamber further comprises fins for dissipating absorbed heat.

13. The in-line heater according to claim 12 further comprising means for delivering a stream of air into the chamber but external to the vessel to remove heat absorbed by the chamber.

14. An in-line heater for heating an ultra-pure fluid, the in-line heater comprising:

a vessel for carrying the ultra-pure fluid therethrough, wherein the vessel is substantially transparent to radiant energy, further wherein the vessel is chemically inert to the ultra-pure fluid;

a chamber surrounding the vessel, the chamber having a reflective interior surface, wherein the reflective interior surface includes a plurality of parabolic reflectors;

a plurality of radiant energy sources each mounted within the chamber at a focal point of one of the parabolic reflectors for preventing radiant energy emitted by the radiant energy sources from impinging directly onto each other and for reflecting the radiant energy onto the ultra-pure fluid; and a control circuit electrically coupled to the plurality of radiant energy sources for detecting and deactivating a failed one of the plurality of the radiant energy sources and for selectively activating an inactive one of the plurality of radiant energy sources in replacement therefor, such that a heating capacity of the in-line heater remains substantially constant.

15. The in-line heater according to claim 14, wherein the control circuit comprises:

a plurality of switches each coupled to one of the radiant energy sources for activating and deactivating the radiant energy sources;

a plurality of sensors each coupled to one of the radiant energy sources for monitoring operational characteristics of the radiant energy sources and for forming outputs representative of the operating characteristics; and means for controlling coupled to the sensors and configured for coupling to the switches for controlling the operation of the switches based on the outputs from the sensors.

* * * * *